United States Patent [19]

Vitta

[11] Patent Number: 4,934,396

[45] Date of Patent: Jun. 19, 1990

[54] DISPOSABLE/PORTABLE DECONTAMINATION UNIT

[75] Inventor: Michael F. Vitta, Salem, N.H.

[73] Assignee: Vitta Trust, c/o Michael F. Vitta, Trustee, Salem, N.H.

[21] Appl. No.: 281,810

[22] Filed: Dec. 8, 1988

[51] Int. Cl.[5] ..... E04H 15/46

[52] U.S. Cl. ..... 135/107; 135/113; 135/111

[58] Field of Search ..... 135/107, 108, 111, 112, 135/113, 110, 902, 904; 52/66

[56] References Cited

U.S. PATENT DOCUMENTS

| | | | |
|---|---|---|---|
| 2,781,766 | 2/1957 | Kneger | 135/110 |
| 2,936,771 | 5/1960 | Marchfield | 135/107 |
| 3,230,962 | 1/1966 | Hoiness | 135/111 |
| 3,766,844 | 10/1973 | Donnelly | 135/111 |
| 3,925,828 | 12/1975 | Kim | 135/902 |
| 4,642,868 | 2/1987 | Pandell | 135/115 |
| 4,682,448 | 7/1987 | Healey | 135/108 |

FOREIGN PATENT DOCUMENTS

| | | | |
|---|---|---|---|
| 541372 | 10/1956 | Italy | 135/108 |
| 235954 | 6/1925 | United Kingdom | 135/902 |
| 344798 | 3/1931 | United Kingdom | 135/902 |

*Primary Examiner*—Henry E. Raduazo

*Attorney, Agent, or Firm*—Edward A. Gordon

[57] ABSTRACT

A portable/disposable decontamination enclosure unit comprising a frame system which includes first and second rectangular end members and at least two pairs of opposing vertical frame members having opposing ends attached to the first and second rectangular end members, the frame system being adapted to be manually extended from a retracted closed position to an extended open position in which position the frame system forms a generally oblong configuration. The extended frame system is enclosed by a length of lay-flat material substantially impermeable to particulate material forming a bag enclosure member, the bag member being flexible and collapsible and closed at one end to form the bottom of the bag, the other end having a rim edge defining an upper opening to receive the frame system, the bag member being sufficiently long to enclose the frame system when extended. The rim edge is sealed whereby the bag member and enclosed extended frame member define a chamber area substantially impermeable to particular material. A resealable port provides access to the chamber area.

5 Claims, 3 Drawing Sheets

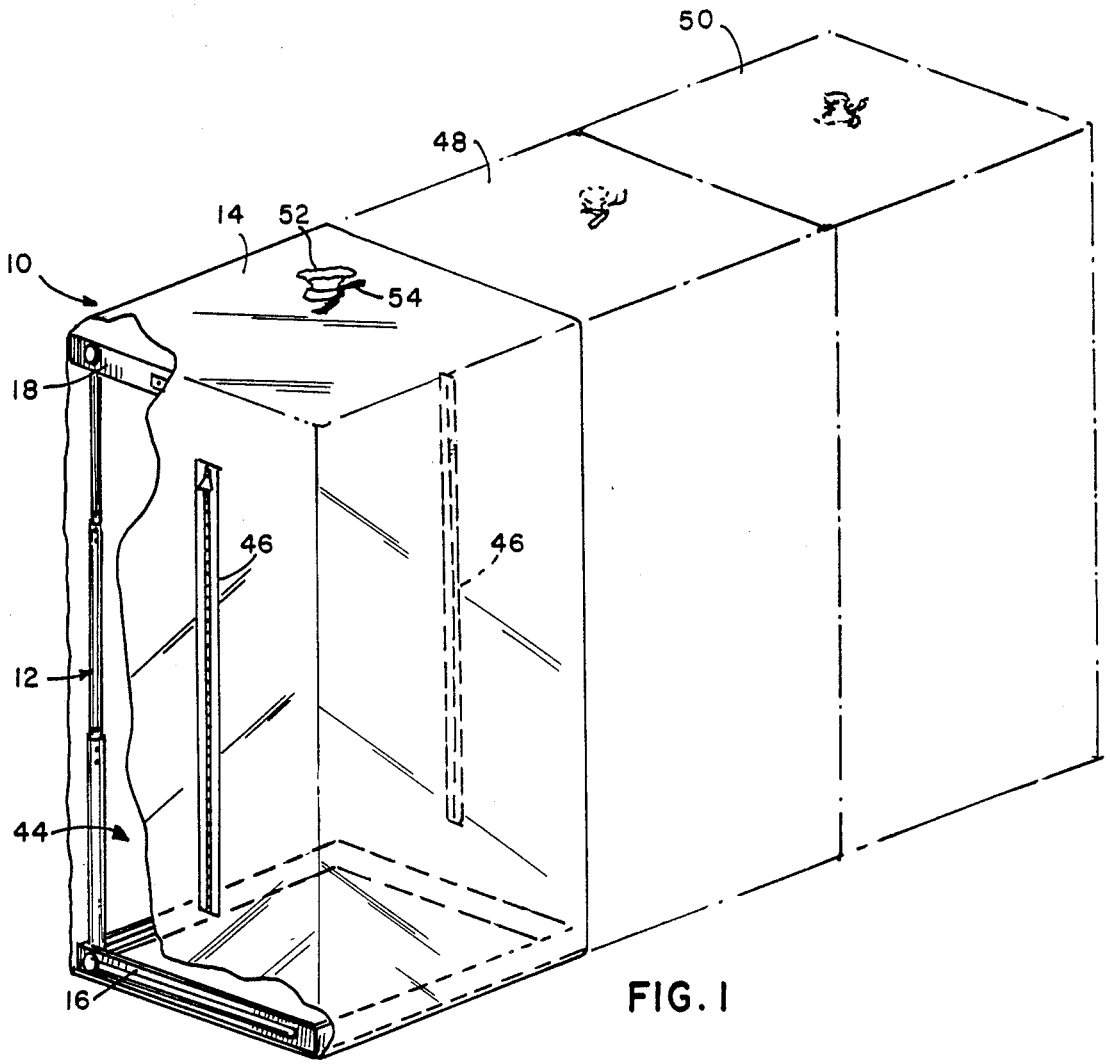
FIG. 1
FIG. 2
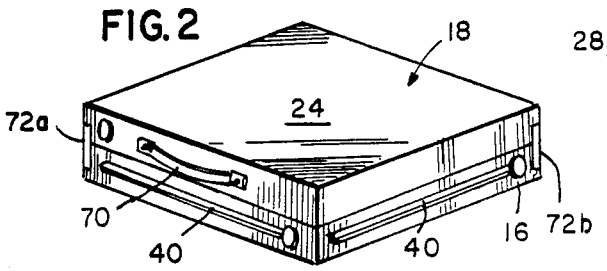
FIG. 3
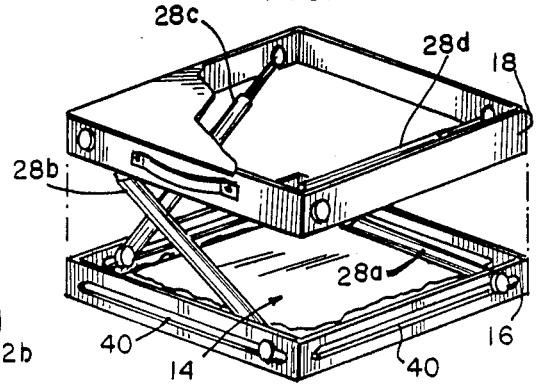

DISPOSABLE/PORTABLE DECONTAMINATION UNIT

BACKGROUND OF THE INVENTION

1. Field of the Invention

The present invention pertains to facilities for cleaning of individuals. Specifically, it pertains to facilities for cleaning or decontaminating of individuals who have been exposed to a dirty or contaminated environment. More particularly, it pertains to facilities for decontaminating workers who have been exposed to asbestos or other contaminates.

2. Description of the Prior Art

In recent years, it has been discovered that individuals who occupy buildings, portions of which are constructed of asbestos material, are subject to health hazards caused by the asbestos. This is particularly true of institutional buildings. Recent laws have been passed requiring the removal of these asbestos materials from buildings, particularly public buildings, e.g. schools, etc. There are certain procedures for making sure that as asbestos is being stripped from a room, the material is collected without contaminating other areas. The workers are also protected by wearing proper suits, hoods and respirators. However, as a worker leaves the room being stripped, it is necessary to decontaminate the worker and his protective clothing so that he does not contaminate other areas.

Because of health hazards associated with asbestos particles, great care must be taken to protect personnel working in asbestos abatement and to avoid escape of fugitive particles from the work space. The U.S. Environmental Protection Agency, the U.S. Occupational Safety and Health Administration, and other regulatory authorities and standard-setting agencies have developed detailed guidelines dealing with asbestos abatement.

Personnel working in asbestos abatement require a decontamination system in which they can change their garments and leave their tools. An example of such a system is disclosed in U.S. Pat. No. 4,604,111 55/97.

Decontamination of an asbestos worker is normally done by having the worker pass through a three-compartment decontamination unit. The worker enters a first compartment (contaminated change area) which may be kept under partial vacuum where he removes his contaminated clothing. Then the worker passes through a second compartment where a shower is normally located for showering and washing off any asbestos materials from his body. Finally, the worker enters a third compartments (clean change area) where he may reclothe himself and exit in a decontaminated state.

The problem with most decontamination units of the type just described is that even though they attempt to be somewhat portable, they are relatively bulky, heavy and expensive. One such unit is manufactured by Evergreen Industries, Inc. of Golden, Colo. While such a unit is more portable and better than other solutions, it is still relatively heavy and expensive since the walls thereof are made of metal and are formed in at least a semi-permanent fashion. Since the decontamination units must be moved from one jobsite to another, these bulky compartments are not as portable as desired.

U.S. Patent No. 4,348,777 55/97 (Peterson) discloses a portable shower facility which is divided into three compartments similar to the facility manufactured by Evergreen Industries mentioned above. However, while the shower of Peterson is semi-portable, all three compartments are mounted as a single skid unit and must be moved together.

U.S. Pat. No. 4,675,923 4/599 discloses a portable decontamination unit having two and preferably three bottom pan units and a multiplicity of parts which must be assembled and disassembled in order to move the unit from one location to another.

While such prior art devices provide improvement in the areas intended there still exists a great need for a portable disposable decontamination unit of a character which is simple in construction, efficient in use and economical in manufacture.

Accordingly, a principal desirable object of the present invention is to provide a new and improved disposable portable decontamination unit having the foregoing characteristics.

A still further desirable object of the present invention is to provide a portable decontamination unit which minimizes assembly components and maximizes ease of assembly.

A still further desirable object of the present invention is to provide a portable decontamination unit which can be readily assembled to provide two or more adjacent enclosures.

A still further desirable object of the present invention is to provide a portable decontamination unit which can be easily constructed in various sizes.

A still further desirable object of the present invention is to provide a portable decontamination unit which can be easily adapted to various uses.

These and other desirable objects of the invention will in part appear hereinafter and will in part become apparent after consideration of the specification with reference to the accompanying drawings and the claims.

SUMMARY OF THE INVENTION

A portable/disposable decontamination enclosure unit comprising a frame system which includes first and second rectangular end members and at least two pair of opposing vertical frame members having opposing ends attached to the first and second rectangular end members, the frame system being adapted to be manually extended from a retracted closed position to an extended open position in which position the frame system forms a generally oblong configuration. The extended frame system is enclosed by a length of lay-flat material substantially impermeable to particulate material forming a bag enclosure member, the bag member being flexible and collapsible and closed at one end to form the bottom of the bag, the other end having a rim edge defining an upper opening to receive the frame system, the bag member being sufficiently long to enclose the frame system when extended. The rim edge is sealed whereby the bag member and enclosed extended frame member define a chamber area substantially impermeable to particulate material. A resealable port provides access to the chamber area.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein:

FIG. 1 is a perspective view, partially broken away, of a portable decontamination unit embodying the principals of the present invention. The view further illustrates by dotted lines an assemblage of additional units;

FIG. 2 is a perspective representation of a decontamination unit of the present invention in a retracted form ready for portaging to a location of use;

FIG. 3 is a perspective view, partially broken away, of the decontamination unit of FIG. 2 illustrating the frame system as partially extended from the retracted closed position of FIG. 2;

DETAILED DESCRIPTION OF PREFERRED EMBODIMENT(S)

Figure 4:
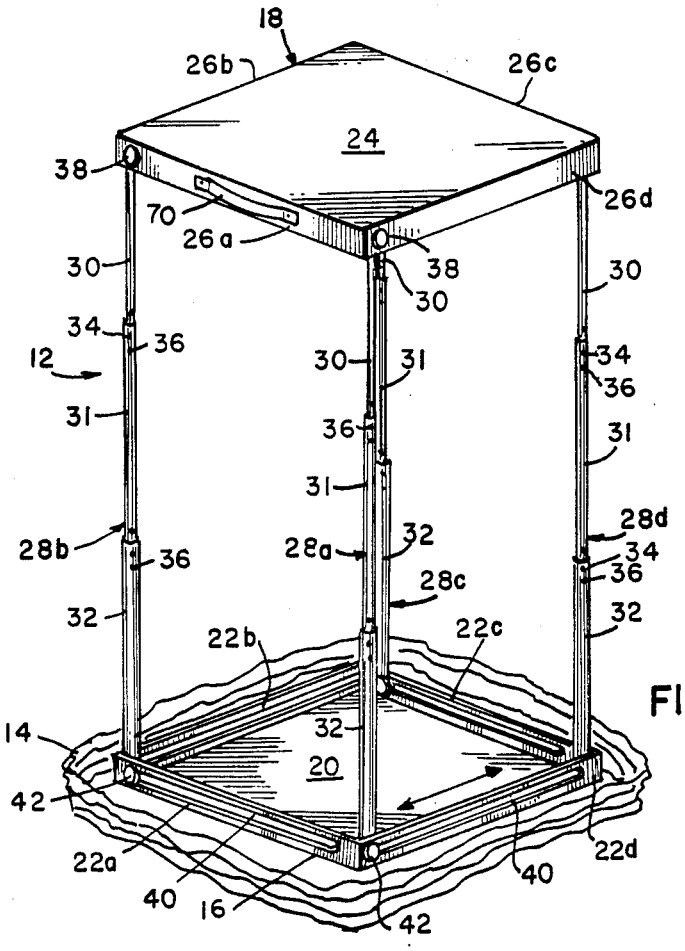
FIG. 4 is a perspective view illustrating the frame system of the decontamination unit of FIG. 2 in the fully extended position and prior to enclosure with the bag cover member.

Referring now to the drawings and more particularly to FIG. 1, there is shown a portable and disposable decontamination unit, indicated generally by the numeral 10, in accordance with the principals of the present invention. As shown, the decontamination unit 10 includes a frame system indicated generally by the numeral 12 and a bag enclosure member 14. The frame system comprises a pair of opposing end members 16 and 18. As shown, the end member 16 serves as the bottom or base support member of the decontamination unit 10 while the end member 18 serves as the top support member of the unit 10. The base end member 16 includes a quadrilateral bottom member 20 extending upwardly from which are side walls **22*a*, 22*b*, 22*c* and 22*d*. The top end member 18 includes top quadrilateral member 24 and extending downwardly from which are side walls 26*a*, 26*b*, 26*c* and 26*d*. The frame system 12 further includes at least two pairs of opposing vertically adjustable frame members 28*a*, 28*b*, 28*c* and 28*d*. As shown, each of the vertical frame members is formed of at least two and preferably three vertical telescoping members 30, 31 and 32 and mating holes 34 which are releasably joined to each other by a suitable bolt means 36 as illustrated with respect to vertical frame member 28*a*. The upper ends 30 of each vertical frame member are pivotally connected to their respective side walls of the upper end member by suitable pins 38. The lower ends 32 of each vertical frame member are pivotally and slidably (as shown by the arrow in FIG. 4) connected to the respective side walls of the bottom member 16 via the elongated slots 40 and bolt means 42 which also serve to releasably secure the members 32 in the upright vertical positions as best seen in FIG. 4. The frame system 12** can be suitably formed of various materials such as wood, metals such as aluminum or steel, plastic or combinations thereof.

Figure 5:
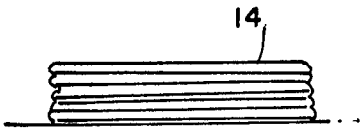
FIG. 5 is a side elevation view illustrating the bag cover member in a folded position.
Figure 6:
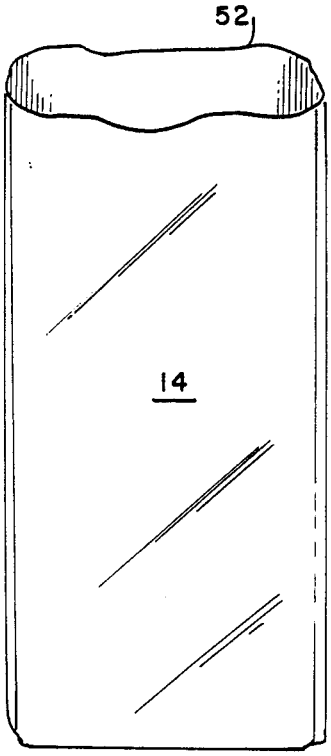
FIG. 6 is a perspective view illustrating the bag cover member of FIG. 5 in an extended open position.

The bag enclosure member 14 is preferably formed of a lay-flat flexible material which is impermeable, especially to particulate material, and which can be easily folded in the form shown in FIG. 5 so that it can be stored within the closed frame system 18 as shown in FIG. 3. As shown in FIG. 1, the rim edge 52 of the bag member can be closed or sealed with a suitable fastener 54 such as a Velcro tab or rope. Also as shown in FIG. 1, access to the chamber 44 can be provided, for example, by cutting an aperture in the bag wall and providing a resealable means such as a Velcro attached zipper means 46 to permit the user to enter and leave the decontamination unit 10. If desired, additional units, for example, 48 and 50 as shown by the dotted lines can be provided to provide an assemblage of the units with accesses to each provided in abutting walls and end walls of the bag members. In this manner, the separate units can be employed by the user as, for example, a contaminated change area, a wash area and a clean area.

Figure 7:
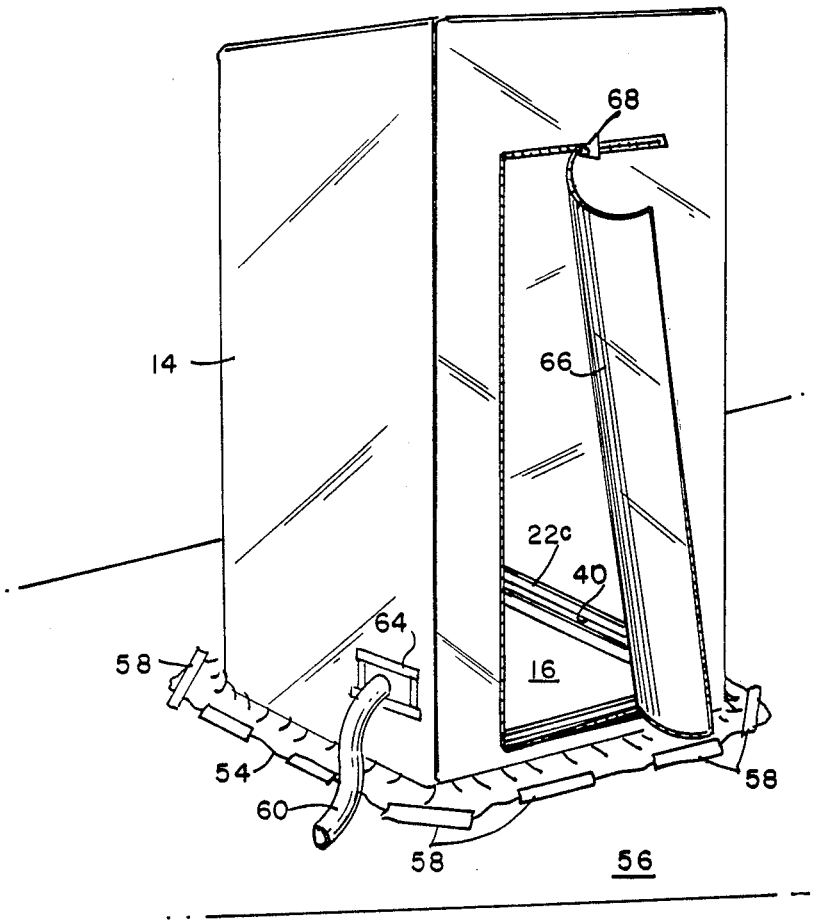
FIG. 7 is a perspective view of an alternate embodiment of a portable decontamination unit embodying the principals of the present invention.

Referring now to FIG. 7, there is shown an alternate embodiment of a decontamination unit in accordance with the present invention. In this embodiment, the frame system is similar to that of FIG. 4. The bag member 14, however, encloses the frame system from the top with the rim edge 52 attached to the supporting platform 56 by tape means 58. Also as shown, a suitable vacuum device 60 (having a filter efficiency of 99.95% at 03 microns or better) can be inserted through a side port and sealed in place. Preferably, during the decontamination process, a negative pressure is maintained in the chamber 62 so that if there is any leakage around the rim edge 52, there will be an inflow rather than an outflow of asbestos fiber contaminated air. Suitably the vacuum device 60 (associated pump not shown) can be sealed to a slit in the bag 14 by suitable tape 64. The entrance panel 66 can be formed and releasably sealed with an attached zipper means 68 as discussed hereinbefore.

Typically, the decontamination unit 10 will be initially in the form shown in FIG. 2 provided with at least one handle member 90 as well as removable latches **72*a* and 72*b* to secure the end members 24 and 16 together so that the unit can be easily carried to the desired location. At the desired location the latches 72*a* and 72*b* are removed and the frame system 12 manually raised to the fully extended position as shown in FIGS. 3 and 4. The bag member 14 is removed and placed under the end member 16 as best seen in FIG. 4 and then the rim edge 52 raised to enclose the frame system and the rim edge sealed by band 54 (as best seen in FIG. 1). The access zippered opening can then be provided. The user will then enter the unit chamber 44** and remove his contaminated clothes and associated working apparatus. The chamber may be placed under partial vacuum so that no contaminants escape to the surrounding atmosphere. Thereafter the user will leave the unit or enter the adjacent units if an assemblage is provided. When the work is complete the decontamination unit(s) can be disposed of.

The bag member is preferably formed of a suitable plastic material such as, for example, polyvinyl chloride or polyethylene. The thickness of the plastic material can be varied and is preferably from 8 to 20 mil thick.

In an alternate embodiment of the invention, a conventional air filter means (not shown) can be disposed in the bag member to permit air to enter and filtered air to exit the enclosure unit when required. Such air filter means can be attached in the same manner as vacuum device 60.

Thus the decontamination unit of the present invention is easily transportable to a job site, easy to assemble and efficient in use. The unique simple and economical construction enables the unit to be disposable when use is complete thereby providing the necessary isolation of contaminants therein.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A portable decontamination enclosure unit comprising:

a frame system comprising:

(a) first and second opposing end members;

each of said opposing end members comprised of a quadrilateral base member and side walls extending outwardly from said base member which collectively form an open-ended container; and (b) quadrilaterally disposed frame means comprised of vertically extendable telescoping members each having one end pivotally connected to a side wall of the first end member, and the other end slidably and pivotally connected to the corresponding side wall of the second end member;

said quadrilaterally disposed frame means enabling the opposing first and second end members to be retracted to a closed position whereby said open-ended containers form an enclosure in which a bag member may be carried;

said frame system forming a generally oblong configuration when in the extended position;

a length of lay-flat material substantially impermeable to particulate material forming a bag member;

said bag member being flexible and collapsible;

said bag member being closed at one end, the other end having a rim edge defining an opening to receive said frame system;

said bag member having a sufficient size to enclose said frame system when in the extended position;

sealing means for sealing said rim edge whereby said bag member and enclosed extended frame system define a chamber area substantially impermeable to particulate material; and resealable means providing access to and egress from said chamber.

2. A portable decontamination enclosure unit according to claim 15 wherein said bag member is formed of a plastic material.

3. A portable decontamination enclosure unit according to claim 15 wherein said plastic material is polyethylene.

4. A portable decontamination enclosure unit according to claim 15 further comprising means for introducing a negative air pressure into said decontamination unit during use.

5. A portable decontamination enclosure unit according to claim 15 wherein said rim edge enables removal of said frame system from said bag member when the enclosure unit has received hazardous material whereby said bag member may be collapsed and sealed for disposal.

* * * * *